US008510961B2

(12) United States Patent
Nicholson

(10) Patent No.: US 8,510,961 B2
(45) Date of Patent: Aug. 20, 2013

(54) PLANER CUTTING TOOLS

(75) Inventor: Marcus Nicholson, Pocklington (GB)

(73) Assignee: Power Box AG, Zug (CH)

( * ) Notice: Subject to any disclaimer, the term of this patent is extended or adjusted under 35 U.S.C. 154(b) by 967 days.

(21) Appl. No.: 12/226,392

(22) PCT Filed: Apr. 10, 2007

(86) PCT No.: PCT/GB2007/001317

§ 371 (c)(1),
(2), (4) Date: Apr. 1, 2009

(87) PCT Pub. No.: WO2007/128989

PCT Pub. Date: Nov. 15, 2007

(65) Prior Publication Data

US 2009/0300925 A1 Dec. 10, 2009

(30) Foreign Application Priority Data

Apr. 10, 2006 (GB) ..... 0607171.6

(51) Int. Cl.
*B27G 17/02* (2006.01)
*B27C 1/10* (2006.01)

(52) U.S. Cl.
USPC ..... 30/481; 30/374; 30/484

(58) Field of Classification Search
USPC ..... 30/475–477, 481, 484, 490, 482
See application file for complete search history.

(56) References Cited

U.S. PATENT DOCUMENTS

| | | | | | |
|---|---|---|---|---|---|
| 6,304 | A | * | 4/1849 | Blye | 30/481 |
| 11,235 | A | * | 7/1854 | Pierce et al. | 30/484 |
| 19,620 | A | * | 3/1858 | Chandler | 30/481 |
| 33,240 | A | * | 9/1861 | Cross | 30/481 |
| 43,360 | A | | 6/1864 | Williams | |
| 106,808 | A | * | 8/1870 | Garland | 30/481 |
| 173,984 | A | * | 2/1876 | Mortensen | 30/490 |
| 228,766 | A | * | 6/1880 | Kinney | 30/481 |
| 303,338 | A | * | 8/1884 | Gibbs et al. | 30/490 |
| 323,595 | A | * | 8/1885 | Preston | 30/481 |
| 434,361 | A | * | 8/1890 | Skattebo | 30/481 |
| 584,002 | A | * | 6/1897 | Lindfors | 30/481 |
| 591,662 | A | * | 10/1897 | Traut | 30/490 |
| 701,471 | A | * | 6/1902 | Dennis | 30/481 |
| 857,514 | A | * | 6/1907 | Beasley | 30/481 |
| 1,012,591 | A | * | 12/1911 | Bodmer et al. | 30/486 |

(Continued)

FOREIGN PATENT DOCUMENTS

DE 29522426 U1 10/2003

*Primary Examiner* — Hwei C Payer
(74) *Attorney, Agent, or Firm* — Woodard, Emhardt, Moriarty, McNett & Henry LLP

(57) ABSTRACT

The invention of this application relates to a hand or power tool which can be used as a planer such that the movement of the tool along a workpiece causes a portion of the material of the workpieces to be removed by at least one cutter blade provided on the tool at a baseplate of the tool which contacts with the workpiece. The tool is provided with at least one movable portion which can be moved with respect to the baseplate and hence the tool. The movable portion can be angularly movable to allow a chamfer cut to be accurately achieved and/or can be slidably movable with respect to the baseplate so a to protrude from an edge thereof to allow greater cutting accuracy to be achieved. In a further embodiment the movement portion can be provided so as to be moved to allow user access to at least one debris conduit.

6 Claims, 4 Drawing Sheets

(56) References Cited

U.S. PATENT DOCUMENTS

Figure 1:
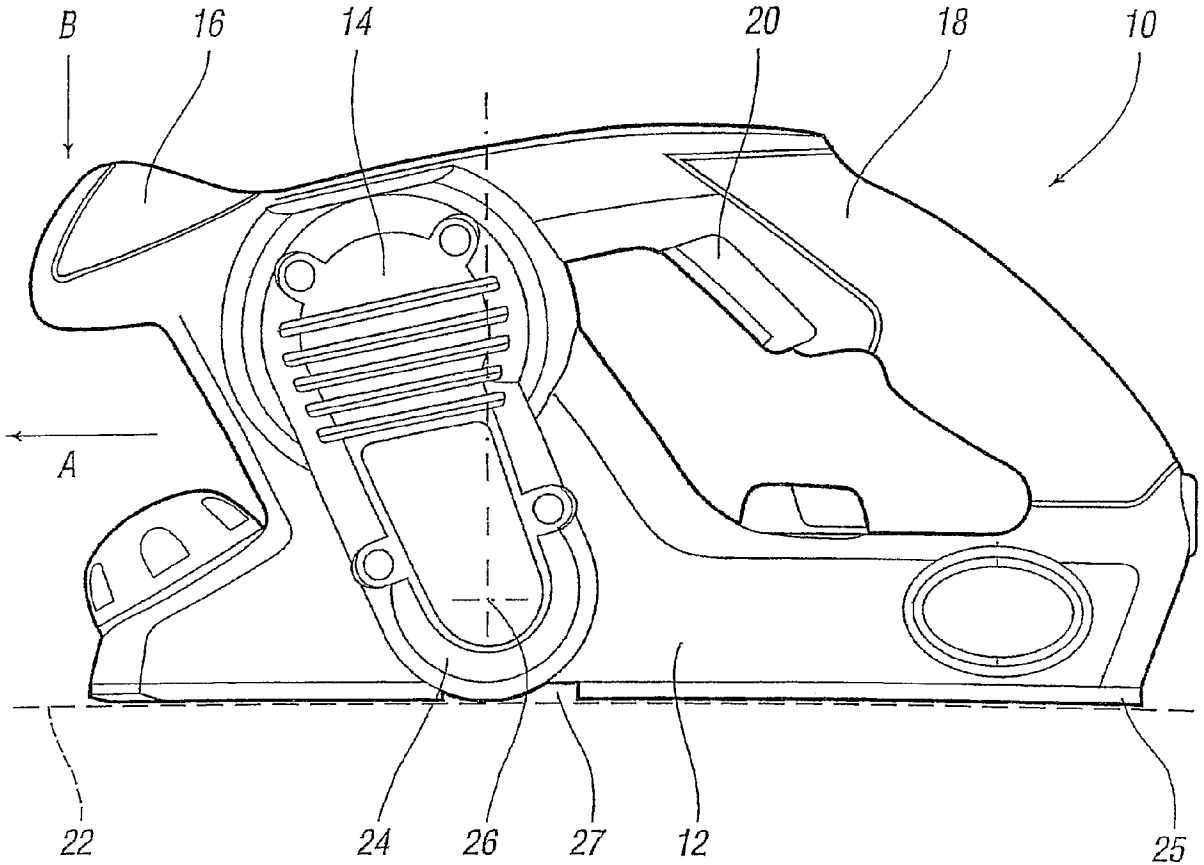

| | | | | | |
|---|---|---|---|---|---|
| 1,021,631 | A | * | 3/1912 | Savage | 30/484 |
| 1,554,929 | A | * | 9/1925 | Vogel | 30/478 |
| 1,699,395 | A | * | 1/1929 | Johansson | 30/481 |
| 2,597,158 | A | * | 5/1952 | Mastripolito | 30/481 |
| 2,672,172 | A | * | 3/1954 | Godfrey et al. | 30/475 |
| 4,442,878 | A | | 4/1984 | Moriguchi et al. | |
| 4,777,726 | A | * | 10/1988 | Flowers | 30/374 |
| 4,790,072 | A | * | 12/1988 | Edwards | 30/376 |
| 5,649,366 | A | * | 7/1997 | Scheiman | 30/374 |
| 7,159,323 | B2 | * | 1/2007 | Petrenko | 30/373 |
| 2005/0160607 | A1 | * | 7/2005 | Petrenko | 30/371 |

* cited by examiner

PRIOR ART

PLANER CUTTING TOOLS

The present invention relates to cutting tools and in particular to hand tools or power tools having a base plate which contacts a work surface during a planing operation.

It is well known for a number of hand tools and, in particular, handheld power tools to have a base plate. Generally the base plate provides a flat contact surface upon which the power tool can be aligned with a workpiece. Contact with a generally flat workpiece is therefore maintained over the area of the base plate surface such that the tool cannot be inadvertently tilted or otherwise moved out of alignment.

The correct contact between the base plate and the work surface is important in that it serves to align a cutter during operation of the tool. In the case of a handheld planer, the cutter extends a short way below the base plate so as to remove a thin layer of material from the exposed surface of the workpiece. In order to ensure accurate removal of material, it is a requirement that the surface of the workpiece be flat so as to provide a reliable contact with the base plate.

However problems can arise when there is not a continuous flat work surface upon which the base plate can rest, such as towards the end of a workpiece or else in the vicinity of an edge thereof. In such instances it is required for the tool operator to judge the correct angle for the tool by eye and to manually hold the tool at that angle during operation. This is not straightforward especially since a user will normally be looking down from above the tool during use, making it difficult to see the angle of the base plate relative to the workpiece. Even if a user can accurately determine the angle at which the tool should be held, it is not straightforward to hold the tool constantly at that angle whilst moving the tool over the work surface during operation.

It will therefore be appreciated that a significant degree of skill is required when using conventional hand tools of this type. Whilst this may be acceptable for those skilled in the trade, conventional tools can lead to mistakes being made by a more casual user.

In addition, a number of known power tools include a debris conduit or channel extending from the cutting edge of the tool such that chippings can be directed away from the work surface in a direction which does not cause inconvenience to the user. However the debris passage within the tool can come blocked or clogged by the debris itself, this inhibiting proper removal of subsequent debris from the cutting region. When a tool becomes clogged in this manner, the enclosed nature of the debris passageway can make unclogging of the tool and arduous task. In particular for electric planers there is little clearance between the cutting blade and the blade housing, resulting in restricted access for clearing any blockage.

It is particularly unfavourable for a user to have to insert an implement or else a digit into the passageway way to remove the blockage in the vicinity of the blade since the possibility of the cutting blade starting up presents a hazard. If a user inserts an implement from the opposing end of the channel then the debris is often simply pushed towards the blade, potentially worsening the blockages.

The above problems are compounded by the need for the hand tool to be able to carry out a standard operation in both an ergonomic and reliable manner such that a user can perform the majority of work unhindered by features which are only to be used a fraction of the time.

In view of the foregoing problems, the present invention aims to provide an improved hand tool which simplifies a number of operations for the user.

According to the present invention there is provided a hand or power planer tool having a housing and a base plate, the base plate being arranged to contact a work surface during operation and a cutter being mounted relative to the base plate so that the cutter can cut into the work piece to a required depth and/or orientation as a result of the relative movement between the cutter and the workpiece, characterised that at least a portion of the base plate is selectively movable relative to the remainder of the tool.

According to one embodiment, the movable portion of the base plate can pivot relative to the housing and/or the remainder of the base plate. Typically the said movable portion of the base plate is lockable at multiple angles relative to the housing.

A tool having a portion as described above is particularly advantageous in that the movable portion can be pivoted to a required angle such that the angle of the tool relative to a work piece can be actively constrained without the requirement for the user to judge the angle by eye. Furthermore when the tool is moved along the work piece, the angle of orientation of tool is maintained, thus achieving a consistent angle of cut. In this way, a chamfer can be accurately and reliably cut using, for example, a planer, without the need for the user to be proficient in the use of the tool in question.

At least one scale, to provide a length indication and/or angle indication may be provided on the movable portion of the base plate so as to indicate the alignment and/or depth of cut to a user.

The movable portion may be pivoted between a first position in which the movable portion is disposed within a recess within the base plate, and a second position in which the movable portion extends from the remainder of the base plate. When disposed in the first position, the movable portion may be substantially flush with, or else recessed from the remainder of the base plate such that the tool can be used in a normal operation mode. Typically the movable portion is substantially planar in shape and may take the form of a chamfer support shoe.

The movable portion of the base plate may be pivotal about an axis which is substantially parallel to the direction of movement of the hand tool during use.

According to an alternative embodiment, the housing may include an opening therein, said opening allowing access part way along a debris conduit. In such an embodiment, the movable portion may be movable between a first position in which the movable portion covers the opening and a second position in which the opening is exposed.

Such an embodiment advantageously allows selective access to a debris conduit at a distance removed from the cutting edge of the tool and wherein the conduit remains substantially enclosed during operation of the tool. The movable portion may include one or more shaped formations with one or more correspondingly shaped formations being provided on the housing and/or an immovable portion of the base plate. Such formations may limit the freedom of movement of the movable portion of the base plate such that the movable portion can only either pivot and/or slide in a linear fashion relative to the remainder of the base plate. Such formations may take the respective form of a hinge, or else a linear grove or slot. In this embodiment the movable portion takes the form of an access hatch.

Typically the formation prevents the movable portion being completely detached from the remainder of the housing such the movable portion cannot be lost. However, according to one embodiment, the movable portion may be completely detachable from the remainder of the tool.

According to a preferred embodiment the movable portion includes a first surface which forms a portion of a contact surface of the base plate and an opposing surface which, at least in part includes formations to selectively locate the movable portion relative to the opening. Typically the locating formations are shaped to correspond to the shape of the opening. According to the preferred embodiment the movable portion is selectively lockable in the first position such that the movable portion cannot inadvertently move during operation.

According to an alternative embodiment, the movable portion may be slidable between a first position in which the movable portion is substantially maintained within a recess in the base plate and a second position in which the movable portion extends beyond a front edge of the base plate. Typically the movement of the movable portion is constrained substantially to a direction which is parallel to the direction of movement of the hand tool during use.

Such a sliding base plate portion is particularly advantageous in that the sliding portion can be extended from the front end of the tool so as to allow correct alignment of the tool prior to a cut being made. By increasing the length of the base plate portion in front of the cutter, it is much less likely that a user will inadvertently hold the tool at an incorrect angle for cutting. Increased control and stability is therefore provided in a manner which provides the user with feedback and assurance of the angle of cut prior to commencing the cutting operation.

Typically the movable portion is U-shaped and includes two arm portions arranged to slot into correspondingly shaped grooves within the base plate.

In one embodiment each of the arm portions has an elongate aperture therein and each of the slot portions has a pin extending therefrom, such that the pin aligns within the aperture in each arm so as to inhibit the motion of the sliding member to the length and direction of each slot. Typically a front edge of the sliding member is angled at least in part so as to provide a lip.

According to one embodiment each pin or screw is shaped so as to maintain a contact surface of the movable portion flush with the contact surface of the base plate. Typically each pin is tapered. Preferably the side walls of the slots are correspondingly shaped so as to engage with the tapered edge of the pin.

It should be noted that the tool may include a movable portion which is provided to allow any or any combination of the functions of being pivotably movable and/or slidingly movable and/or allow access to a debris conduit, to be achieved.

In a further embodiment the tool may include a plurality of movable portions, with said portions each provided to allow at least one of the functions of being pivotably movable and/or slidingly movable and/or allow access to a debris conduit to be achieved.

According to a second aspect of the present invention there is provided a hand or powered planer tool having a housing, and a base plate defining a surface for contacting a work surface during use and a cutter mounted relative to the baseplate, wherein the base plate comprises a first portion which is fixed relative to the housing and a movable portion which is pivotable relative to the housing such that the power tool is usable in a first operation mode in which the pivotable portion is in a first position and a second mode in which the pivotable portion is angularly spaced from the first position.

Typically the pivotable portion can be moved between a first position in which the pivotable portion is substantially flush with a remaining portion of the base plate and a second position in which the pivotable portion extends from the remaining portion of the base plate.

According to a third aspect of the present invention, there is provided a hand or power tool having a housing and a base plate, the base plate being arranged to contact a work surface during use of the tool and a cutter being mounted relative to the base plate so that the cutter can cut into the work piece to a required depth and/or orientation as a result of relative movement between the cutter and the workpiece, wherein a portion of the base plate is movable relative to the remainder of the base plate between a first retracted position and a second extended position in which the said movable portion extends outwardly from an edge of the base plate.

According to a further aspect of the present invention, a planer power tool having a housing and a base plate, the base plate being arranged to contact a work surface during operation and a cutter being mounted relative to the base plate so that the cutter can cut into the work piece to a required depth and/or orientation as a result of the relative movement between the cutter and the workpiece, the power tool including a conduit for directing cuttings from the workpiece, wherein at least a portion of the base plate is movable so as to selectively expose an internal portion of the conduit.

Figure 3A:
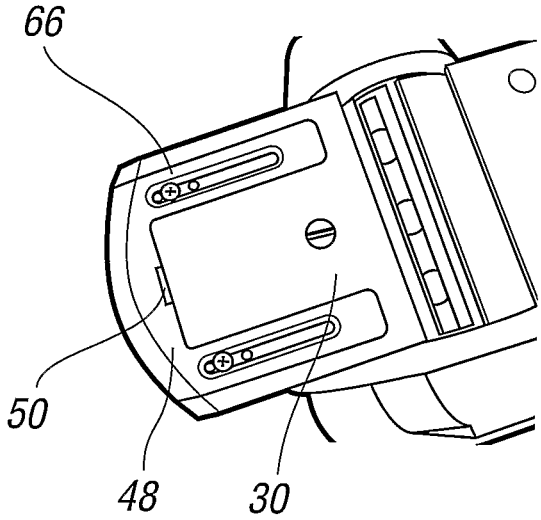
Figure 3B:
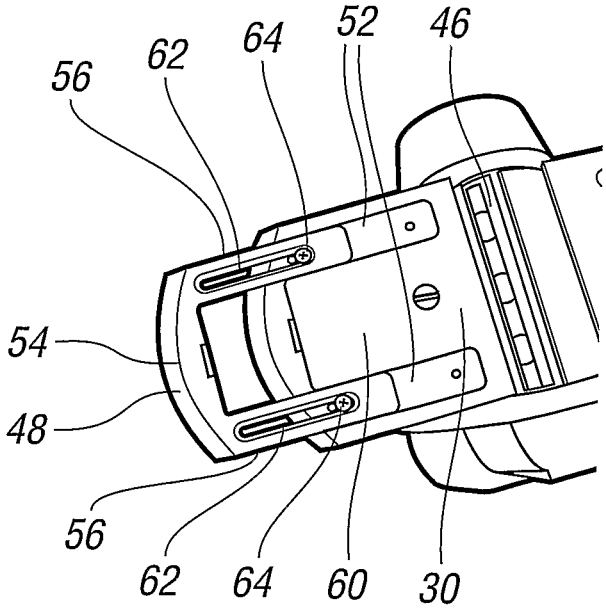
Figure 3C:
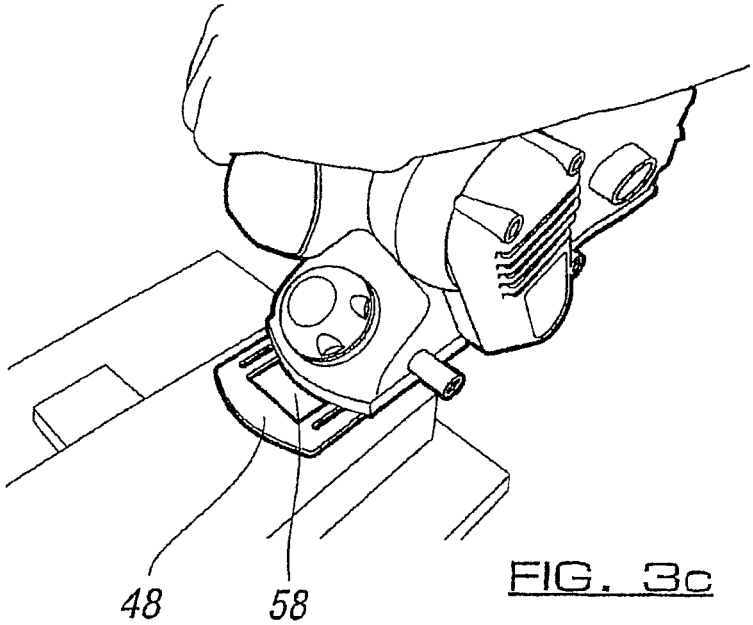
Figure 4:
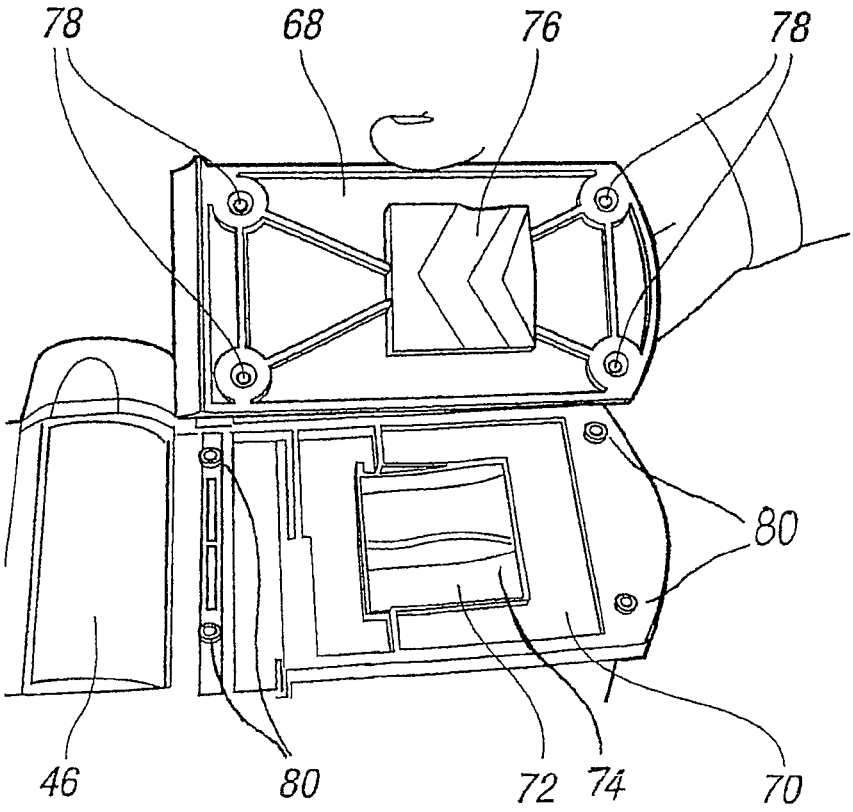

Specific embodiments of the present invention will not be described in further detail below in relation to the following drawings in which:

FIG. 1 shows a side view of a hand tool according to the prior art;

FIGS. 2*a-d* show a first embodiment of a hand tool according to the present invention;

FIGS. 3*a-c* show a second embodiment of a hand tool according to the present invention; and FIG. 4 shows a hand tool according to a third embodiment of the present invention.

Turning firstly to the arrangement of FIG. 1, there is shown in general a hand-held electric power tool in the form of a hand-held planer 10 according to the prior art.

The planer 10 in FIG. 1 includes a housing 12 which houses a motor 14. The housing 12 is provided with a front handle 16 and a rear handle 18 such that the user can securely hold the planer 10 during use. In particular a user can grip the rear handle 18 and operate switch 20 so as to actuate the motor 14 for operation. A user then applies pressure to the rear handle 18 in order to move the planer during operation in the direction of arrow A. At the same time, a downward pressure B is exerted onto the planer by a front handle 16 so as to ensure the planer maintains the required contact with the work surface 22 during use.

It can be seen that the planer 10 contacts the work surface 22 via base plate 25. The base plate 25 is generally planar in shape so as to ensure that the planer maintains contact with the work surface substantially over the entire area of the base plate contact surface. The base plate 25 is also provided with an opening 27, through which a cutter can extend so as to make the required depth of cut into the work surface 22. In this regard the planer housing 12 generally includes a cutter body housing portion 24 which contains a cutter generally in the form of a drum 28 which is arranged for rotation about axis 26. Transmission means (not shown) extend between the motor housing 14 and the drum housing 24 such that the output torque from the motor rotates the drum about axis 26 during use.

The FIGS. 2, 3 and 4 each show different embodiments of the present invention which allow a planer to operate in both a conventional operation mode, as described above, and also an additional mode in which the accomplishment of specific tasks is simplified for the user. All of the embodiments make use of the general concept of providing a movable base plate section so as to improve the usability of the planer.

Figure 2B:
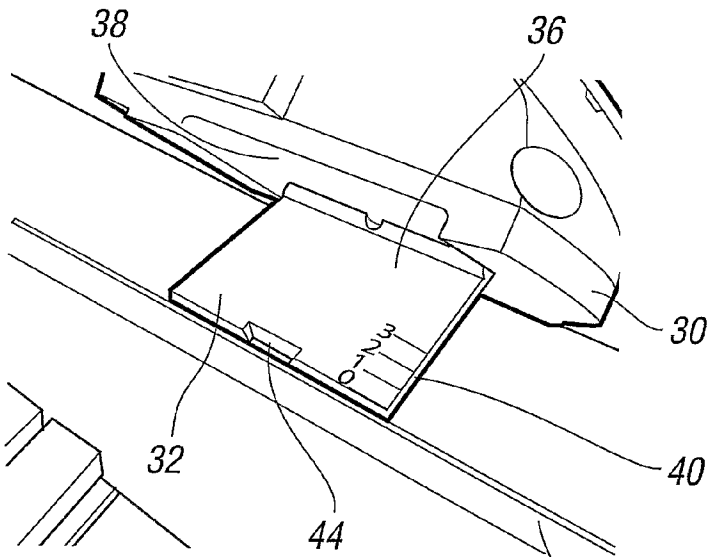
Figure 2D:
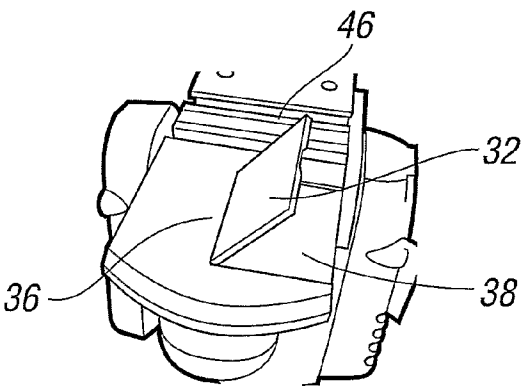
Figure 2A:
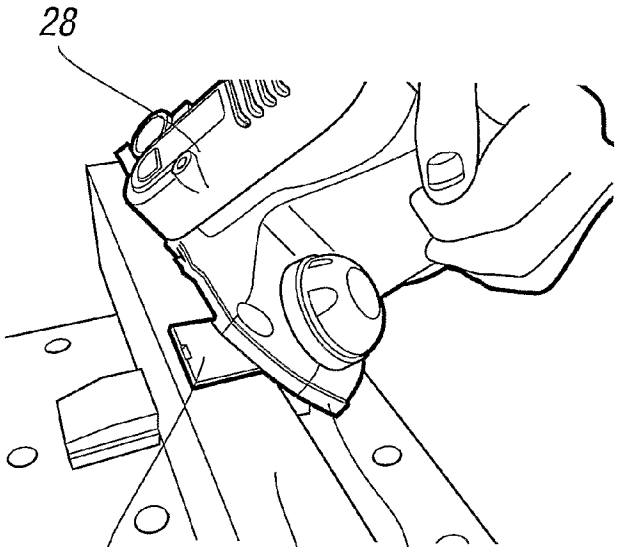

Turning now to the embodiment of FIGS. 2*a-d*, there is shown a planer 28 having a base plate 30 with a movable portion in the form of a chamfer support foot 32. As can be seen in FIG. 2*a*, the chamfer support foot provides a supporting surface to help a user align the planer when cutting a chamfer along an edge of work piece 34.

Figure 2C:
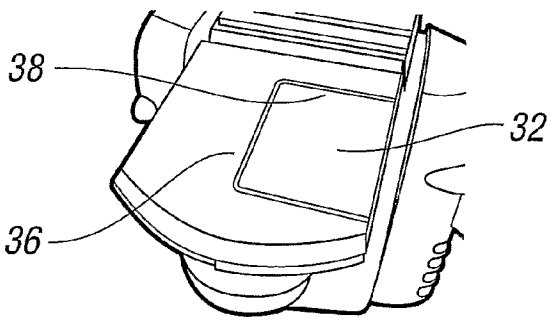

Further details of the chamfer support foot are shown in FIG. 2*b* in which it can be seen that the support foot takes the form of a flat plate which is pivotally mounted to the base plate 30 about a hinge 36. The base plate 30 includes a recess 38 which corresponds to the shape of the chamfer support foot 32. In particular the recess is of a depth such that when the chamfer support foot is folded away within the recess, the surface of the chamfer support foot 32 is substantially flush with the contact surface of the base plate 30 as shown in FIG. 2*c*. When in this position, the planer 28 can be used in a normal operation mode. The contact surface of the chamfer support foot is generally smooth in accordance with the smooth finish of the base plate 30.

The opposing surface of the chamfer support foot is provided with a series of indicators 40 which act as a chamfer measurement guide. Thus during use the indicators can be aligned with a line 42 made on a work piece so that a user can ensure that a constant chamfer is achieved along the entire edge of the work piece. The indicators 40 may be provided in the form of a length scale which allows measurement of the length between the chamfer edge and a fixed point or line.

The opposing surface of the chamfer support foot is also provided with a groove 44 which acts as a thumbnail slot to allow a user access to the opposing side of the support foot. A user can manipulate the support foot between a storage position shown in FIG. 2*c*, which is suitable for normal planer use, and an extended position as shown in FIG. 2*d* in which the planer can be used in a chamfer cutting mode. The chamfer support foot can be angled to several predetermined positions.

Additionally, or else alternatively, the chamfer support foot can be provided with a locking mechanism such that a user can selectively lock the port foot at the required angle. The chamfer support foot would normally be required to pivot between 0° and 90° although it would be straightforward to allow the support foot to pivot in excess of 90° so as to provide for the chamfering of an acutely angled edge of a work piece.

It is envisaged that the provision of predetermined positions will be sufficiently accurate for the majority of users. However if increased accuracy is required, an angular scale maybe provided with the tool, or else an angular scale may be made integral with the chamfer support foot by way of a curved extension arm (not shown) which may extend into a correspondingly shaped recess within the housing when the chamfer support foot is in the storage position.

Typically the chamfer support foot is provided in a front portion of the base plate 30 in the vicinity of the front handle 16, such that the chamfer support foot precedes the cutter 46 when the planer is moved along the work piece.

Turning now to the embodiment of FIGS. 3, 3*a* and 3*b*, there is shown the contact surface 30 of a planer according to a second embodiment. In this embodiment, the movable portion of the base plate is provided in the form of a sliding member 48 which is also referred to as a front shoe extension. The sliding member 48 is provided within a front portion of the base plate 30, which precedes the cutter 46 during operation, otherwise referred to as the front shoe. The front shoe extension is shown in a retracted or storage condition in FIG. 3*a* and in an extended, in use, condition in FIG. 3*b*. Unlike the embodiment shown in FIG. 2, the contact surface of the sliding member 48 remains substantially flush with the contact surface of the base plate 30 in both the retracted and the extended positions.

The sliding member 48 is provided with a thumb nail groove 50 to allow the user to easily grip and slide the sliding member 48 between the extended and the retracted position. The base plate 30 is provided with one or more recesses 52 for receiving the sliding member 48 in the retracted position. The depth of the recesses 52 are substantially equal to the thickness of the sliding member 48.

In the embodiment shown the sliding member is substantially U-shaped such that it is provided with a front edge 54 and two rearwardly extending arm portions 56. Typically the front edge 54 is curved and/or angled as shown in order to provide a lip in order to allow the front edge to glide smoothly over the work piece. The U-shaped arrangement of the sliding member 48 is advantageous in that it provides an opening through which the user can see the work piece during use. In addition a central base plate portion 60 is undisturbed by the front shoe extension such that the correct orientation of the planer is maintained within the vicinity of the cutter 46.

Each of the arms 56 is provided with an elongate slot 62. A pin or screw 64 is received within each slot 62 so as to maintain the adjacency and the alignment of the front shoe extension between both the extended and retracted positions. In addition the recesses 52 in the base plate have linear side walls which engage with the side walls of the sliding member 48 to ensure that the sliding member can only slide in a linear fashion. Both of the screws 64 and the side walls of the slots 62 may be outwardly tapered or otherwise shaped so as to ensure that the sliding member 48 is correctly held adjacent the base plate recesses 52. One or more alignment members may be provided in the form of a sprung loaded ball bearing in order to ensure that the sliding member clicks into position in either the engaged or retracted position. The sprung loaded pin or ball bearing 66 may extend into a correspondingly shaped recess in the opposing side of the sliding member (not shown). In this way the sliding member is bias into the required position.

The sliding member is shown in an in-use condition in FIG. 3*c* such that it extends beyond the front end 58 of the base plate 30 so as to provide a front shoe extension portion which gives the user an increased length in which to level the planer prior to starting the cut.

Turning now to the embodiment of FIG. 4, there is shown a movable base plate portion in the form of a cleaning access hatch. In this embodiment the movable portion is removable from the base plate portion 70 of the planer housing so as to provide a hatch cover 68.

The hatch cover 68 extends rearward of the cutter 46 and has a contact surface which provides the rear portion of the base plate during operation of the cutter. As shown in FIG. 4, the hatch cover also has an opposing side which engages with the base of the housing 70 so as to cover an opening 72 to a debris extraction chamber or passageway 74 during use of the planer.

In the event that a blockage occurs within the debris extraction chamber 74, or else to allow routine inspection thereof, the hatch cover 68 can be opened by the user to allow access to the opening 72 which is partway along the extraction chamber.

The opposing side of the hatch cover 68 which engages with the base of the housing 70 includes a protrusion 76 which extends partway into the opening 72 when the planer is in use so as to allow correct location of the hatch cover 68 relative to the housing 70. Typically the opening 72 and the protrusion 76 are correspondingly shaped. The hatch cover 68 is provided with a series of holes which corresponds to threaded holes 80 provided in the housing base such that the access hatch 68 can be fixed in position by way of screws (not shown). Alternatively a quick release locking arrangement can be provided between the hatch cover 68 and the housing base 70 in the form of one or more clip fixings.

Whilst the hatch cover 68 is described as being entirely removable from the base of the housing 70, another embodiment which is in many ways preferred allows the hatch cover to be pivotally mounted to the housing such that the hatch cover is maintained in position both by way of screws 78 and also a hinge arrangement.

The debris extraction chamber 74 is provided with an inner wall 80 which is profiled along its upper edge. The protrusion 76 on the hatch covet is correspondingly profiled to ensure correct alignment of the protrusion 76 within the opening 72. The correct alignment of the protrusion 76 within the opening 72 is crucial in order to prevent the ingress for egress of dust or other debris ensuring the operation of the tool.

The invention claimed is:

1. A hand or power planer tool having a housing and a base plate, the base plate being arranged to contact a work surface during operation and a cutter being mounted relative to the base plate so that the cutter can cut into a workpiece to a required depth and/or orientation as a result of the relative movement between the cutter and the workpiece, the base plate has a movable portion selectively movable relative to the remainder of the base plate between a first position in which the portion is disposed within a recess in the base plate and a second position in which the movable portion is extended from the base plate about a pivot axis which is substantially parallel with the direction of movement of the tool during use and when in said second position the said portion acts as a chamfer support as the planer tool is moved along the workpiece to perform a planing action and wherein when disposed in the first position the movable portion is substantially flush with, or recessed from, the remainder of the surface of the base plate to allow contact with the workpiece substantially over the entire area of the base plate as the planer tool is moved along the workpiece.

2. A tool according to claim 1 wherein the position of said portion is maintained during movement of the tool along the workpiece to perform the planing action, the tool is used to perform a chamfer cut on the workpiece when the said movable portion is at angle of other than 0 degrees with respect to said remainder of the base plate.

3. A tool according to claim 1 wherein at least one scale indication is provided on the movable portion of the base plate to act as a chamfer guide.

4. A tool according to claim 1 wherein the said portion is substantially planar in shape.

5. A tool according to claim 1 wherein the said portion includes one or more formations, with one or more correspondingly shaped formations being provided on the housing and/or the base plate, which formations serve to guide the movement of the said portion, the formations can take the respective form of a hinge, a linear groove, or a slot.

6. A tool according to claim 5 wherein the formations prevent the movable portion from being completely detached from the tool.

* * * * *